United States Patent [19]

Brown et al.

[11] 4,376,384

[45] Mar. 15, 1983

[54] CLAMP FOR USE IN WINDING LARGE MAGNET COILS

[75] Inventors: Robert L. Brown, Kingston; Walter J. Kenney, Clinton, both of Tenn.

[73] Assignee: The United States of America as represented by the Department of Energy, Washington, D.C.

[21] Appl. No.: 260,624

[22] Filed: May 5, 1981

[51] Int. Cl.[3] ..... B21F 3/02; B25B 5/14

[52] U.S. Cl. ..... 72/135; 269/266

[58] Field of Search ..... 72/135, 139, 142, 146, 72/147, 148; 254/DIG. 6; 269/266; 29/605

[56] References Cited

U.S. PATENT DOCUMENTS

| | | | |
|---|---|---|---|
| 1,453,176 | 4/1923 | Perrine | 269/266 |
| 1,870,244 | 8/1932 | Elston | 254/DIG. 6 |
| 2,722,867 | 11/1955 | Dackor et al. | 269/266 X |
| 3,604,700 | 9/1971 | Gault | 269/266 X |
| 3,746,190 | 7/1973 | Hotz | 254/DIG. 6 |
| 3,750,719 | 8/1973 | Goldman et al. | 72/148 X |
| 3,965,713 | 6/1976 | Horton | 72/146 |

*Primary Examiner*—Ervin M. Combs

*Attorney, Agent, or Firm*—Fred O. Lewis; Stephen D. Hamel; Richard G Besha

[57] ABSTRACT

In one aspect, the invention is a novel arrangement for applying forces to turns of a vertically extending helical coil which is wound about a support. The apparatus includes a first rigid member extending towards the turns. A second rigid member extends transversely from the end of the first and has a vertically extending face provided with a generally straight groove extending transversely of the turns. A longitudinal passage in the first member connects to the groove to form therewith a continuous guideway for rollable articles. A rigid lug longitudinally movable in the groove is provided with a projection which extends out of the groove and beneath the bottom of a selected turn of the coil. A train of rigid, rollable articles is disposed in the guideway inwardly of the lug. Means are provided for applying force to that end of the train which is relatively remote from the lug, to urge the latter against the bottom face of the selected turn. As a result, that turn is moved upward along the face of the support, establishing a selected spacing between that turn and the previously formed turn of the coil. When upward movement of the selected turn stops, the force applied to the lug immediately translates to a force which urges the above-mentioned grooved face against all of the formed turns, thus compressing them against the support. The above-mentioned first and second members are swingably mounted so that they can be temporarily moved out of the winding path, thus permitting continuous winding.

10 Claims, 2 Drawing Figures

CLAMP FOR USE IN WINDING LARGE MAGNET COILS

BACKGROUND OF THE INVENTION

1. Field of the Invention

This invention relates generally to force-applying devices. More particularly, it relates to a clamping device designed to facilitate coil-winding operations. The invention is a result of a contract with the United States Department of Energy.

2. Related Art

This invention was developed to overcome problems encountered in producing a generally D-shaped helical coil by winding a copper conductor about the hub of a suitable frame, or bobbin. The conductor to be so wound was a copper bar of oblong cross-section, one edge-face of the bar being provided with adherent non-conductive pads for ensuring a selected between-turn spacing between the turns of the coil. Winding was conducted by securing an end of the conductor to an upper part of the hub and then rotating the bobbin about a vertical axis to wind the conductor downwardly about the hub. Several conventional clamping assemblies were mounted to the bobbin at selected points about the circumference of the hub to expedite winding. Each assembly included a frame carrying three manually operated clamps of the toggle type. The clamping assemblies were provided to serve two principal functions. First, after the laydown of a typical turn of the coil, the assemblies were used to force that turn upwardly against the previously formed turn to reduce the spacing therebetween to the value set by the pads. Second, the assemblies then were repositioned and used to apply radial force to all of the turns formed thus far, to press them against the hub. In the course of winding any given turn, each of the clamping assemblies had to be completely removed from the bobbin temporarily to make way for the conductor. The clamping assemblies were generally unsatisfactory. As indicated above, they required frequent repositioning and removal, and they did not permit continuous winding. Furthermore, it was difficult for one operator to remove and re-install a clamping assembly.

SUMMARY OF THE INVENTION

Objects

It is an object of this invention to provide a clamping device of novel design.

It is another object to provide a relatively simple, reliable, and easily adjusted clamping device.

It is another object to provide a clamping device for applying force in a first direction to move an object against a stop and then, without re-adjustment, applying force to the object in a direction at right angles to the first direction.

It is another object to provide a mechanical clamping device which does not require the use of fluids.

It is another object to provide a clamping device which facilitates coil-winding operations and which permits continuous winding.

Additional objects, advantages and novel features of the invention will be set forth, in part, in the description which follows, and will either become apparent to those skilled in the art upon examination of the following or may be learned by practice of the invention.

Summary

In one aspect, the invention comprises force-applying apparatus which includes a horizontally extending member having a vertically extending end face. The end face extends normal to the axis of the member and is formed with a vertically extending groove. The member includes a longitudinally extending passage which connects with the groove to form therewith a continuous guideway for rollable articles. A rigid lug is mounted for longitudinal movement in the groove and is formed with a projection which extends laterally from the groove. A train of rollable, rigid articles is disposed in the groove inwardly of the lug. The apparatus includes means for applying force to that end of the train which is relatively remote from the lug, to apply to the lug a force urging it upwardly in the groove.

In another aspect, the invention is an apparatus for applying force to turns of a vertically extending helical coil which is wound about a support. The apparatus includes a first rigid member extending towards the turns. A second rigid member extends transversely from the end of the first and has a vertically extending face provided with a generally straight groove extending transversely of the turns. A longitudinal passage in the first member connects to the groove to form therewith a continuous guideway for rollable articles. A rigid lug longitudinally movable in the groove is provided with a projection which extends out of the groove and beneath the bottom face of a turn of the coil. A train of rigid, rollable articles is disposed in the guideway inwardly of the lug. Means are provided for applying force to that end of the train which is relatively remote from the lug, to urge the latter against the bottom face of the turn. In still another aspect, the apparatus just described is designed so that the first member is arcuately movable about an axis parallel to its own axis.

Figures 1, 2:
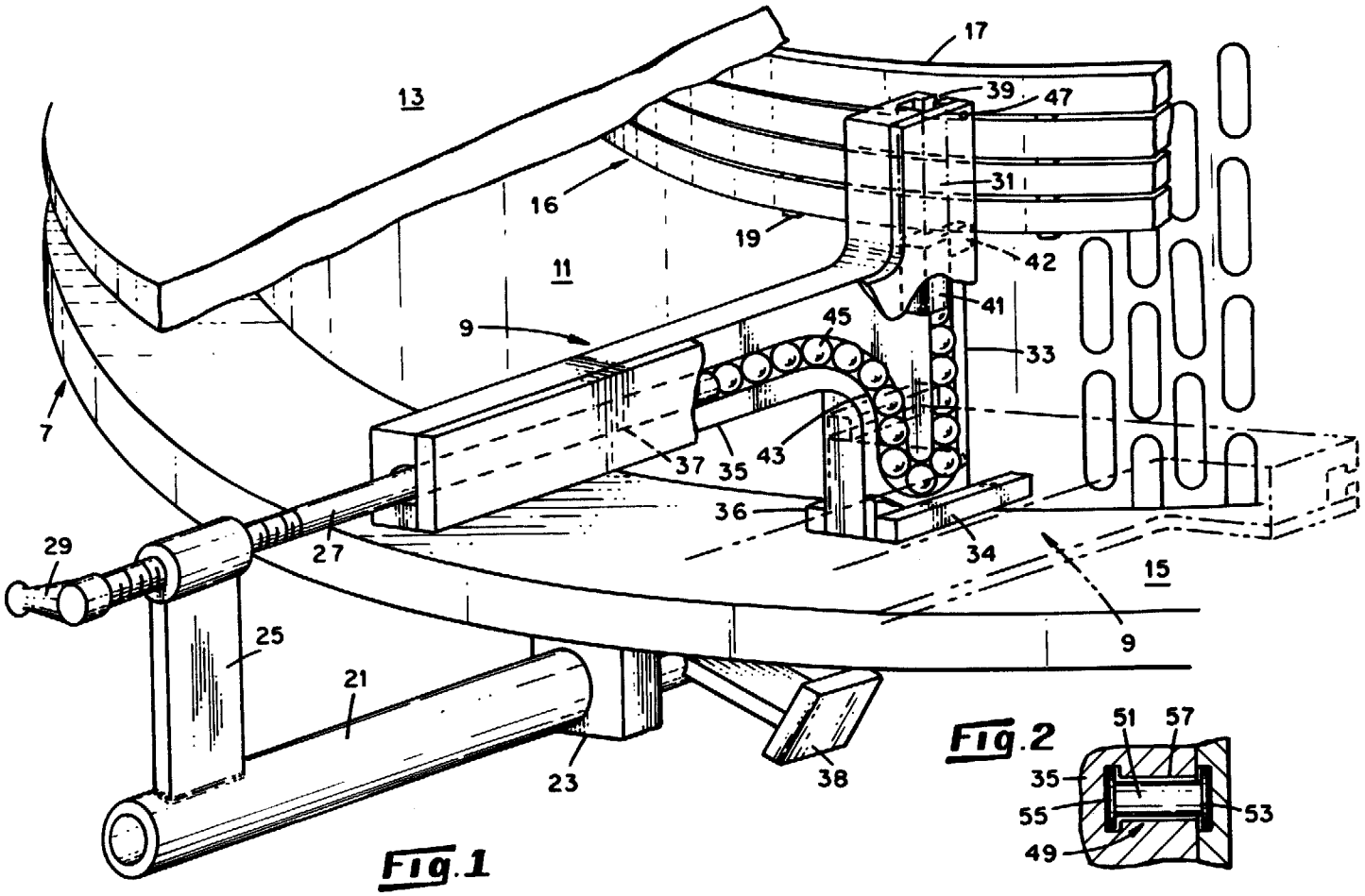
FIG. 1 is a partial side view in perspective of a conventional coil-winding assembly, to which is mounted a clamping device designed in accordance with the present invention. Two positions of the clamp are shown: a normal operating position (solid lines) and a displaced position (broken lines)
FIG. 2 is a cross-sectional view of a member 35 (FIG. 1) as modified to receive a roller chain in accordance with an alternative form of the invention.

This invention is applicable to the clamping of workpieces of various configurations, but for brevity it will be illustrated as used in the winding of electrical coils of the kind referred to above.

FIG. 1 illustrates a conventional coil-winding frame 7, or bobbin, to which is mounted a clamping device 9 designed in accordance with the invention. The bobbin includes a slotted tubular hub 11, mounted between horizontally extending top and bottom plates 13 and 15, respectively. The bobbin is mounted for rotation about the axis of the hub so as to wind an electrical conductor 17 about the hub and form a continuous helical coil 16. Four turns of the coil are shown. Prior to winding, non-conductive spacers 19 are mounted to an edge of the conductor to provide a selected spacing between adjacent turns of the finished coil.

As will be described, the clamping device is used to (1) force each newly formed turn of the coil upward against the previously formed turn to reduce the spacing therebetween to the design value; and (2) immediately apply radially inward force to all of the turns formed thus far, to compress them against the hub. The clamping device also is designed to be easily moved into and out of its normal operating position, so as to permit continuous winding of the coil.

As shown in FIG. 1, a preferred embodiment of the clamping device 9 includes a rotatable support rod 21, which extends radially outward from the bottom plate 15 of the bobbin, the rod being journaled in bearings, such as 23, affixed to plate 15. Extending laterally from the outer end of the rod is an arm 25 whose outer end is bored and tapped for rotatably suporting a threaded section of a shaft 27 which extends radially inward between the plates 13 and 15, toward the hub. The outer end of the shaft is affixed to a handcrank 29. The inner end of shaft 27 supports a generally T-shaped clamping device 9 for applying forces to the coil being wound, as will be described. In the normal operating position shown, the crossbar 31 of the clamping device extends vertically, with an end face 33 of the crossbar confronting the hub 11. The lower end of the crossbar carries stand-offs 34 and 36. These have a length corresponding to the thickness of the conductor 17 and bear on the hub (or on a previously formed layer of the coil) to maintain the crossbar end face 33 vertical. Any suitable counterweight 38 is affixed to the aforementioned support rod 21 to bias the clamping assembly 9 to the position shown in phantom.

As shown, the leg 35 of the T-shaped member extends radially outward and is formed with an axial passage 37 for reception of the inner end of the shaft 27. The end face 33 of the crossbar is formed with a vertically extending T-shaped groove 39 for receiving a slidable lug 41. A portion 42 of the lug projects out of the groove and extends radially toward the hub for a distance somewhat less than the thickness of the conductor 17. As shown, the groove 39 extends downwardly from the top face of the crossbar and is connected, via a passage 43, to the aforementioned axial passage 37. The groove and passages cooperatively form a guideway which is sized and contoured to accommodate a train of unconnected balls 45 for transmitting force from shaft 27 to the lug 41. Any suitable means, such as a removable pin 47, is provided to ensure retention of the balls and lug 41 in the clamping assembly. If desired, the T-shaped member may be provided with an aperture-and-detent arrangement, or other suitable arrangement, to facilitate insertion and removal of the balls 45.

In FIG. 1, the clamping device 9 is shown as positioned next to a segment of the hub 11 to reduce the spacing between newly formed turn four and previously formed turn three. As shown, projection 42 of the lug extends beneath turn four. The operator now turns the crank to advance shaft 27 against the balls 45 and apply upward thrust to turn four via lug 41, thus reducing the spacing to the design value set by the pads 19. As soon as upward movement of turn four stops, the force applied by the threaded shaft 37 translates into a radially directed inward force which is applied to all four turns of coil 16 by face 33 of the crossbar. This causes the turns of the coil to conform closely to the configuration of the hub, as is desired. In the course of winding the fifth turn of the coil, the operator retracts shaft 27 to release the pressure on the coil by the crossbar. He then swings the clamping device 9 about the axis of support rod 21 to a position where the T-shaped member is out of the way of the conductor 17 as it is deposited on the hub. Preferably, the clamping assembly 9 is swung to the position shown in phantom, the rotatable T-shaped member being positioned to lie flat against the lower plate 15 of the bobbin. The counterweight 38 maintains the assembly in that position. Following lay-down of the fifth turn for this segment of the coil, the operator backs out shaft 27 sufficiently to permit the counterweight 38 to return the clamping assembly to its normal position and to permit lug 41 to drop to a position below the fifth turn. He then turns shaft 27 inward to move lug 41 upwardly against the fifth turn to establish the desired turn-to-turn spacing and then compress all of the previously formed turns against the hub, as described above.

As more turns of the coil 16 are wound, a point will be reached where the lug 41 reaches the bottom end of the groove 39 and cannot be fitted under additional turns. In this event, the operator may remove pin 47, slide the lug out of the groove, and re-insert the lug in the inverted position. The projection 42 now will be in a lower position (between the standoffs 34,36) and can be used to apply upward thrust to one or more additional turns.

EXAMPLE

A clamping device similar to that shown in FIG. 1 was used in winding operations where a copper conductor was wound about the generally D-shaped hub of a winding frame. The copper conductor (thickness, 1 cm; width, 3 cm) had a hardness of about half-hard. The hub, which was designed for rotation about vertical axis, had a height of 0.3 m, a major axial dimension of 2.5 m, and a minor axial dimension of 1.5 m. The clamping device 9 was composed throughout of aluminum or steel, with the exception of the counterweight 38, which was lead. The end face 33 of the crossbar measured 0.25 m×0.24 m, and the leg 35 measured 0.04 m×0.32 m. The balls 45 were standard ball bearings. The balls and the shaft 27 had diameters of 0.5". The finished coil consisted of several layers, each comprising 19 turns.

The clamping device 9 operated satisfactorily, providing several significant advantages over the standard clamping assemblies previously referred to. That is, the clamping device satisfactorily reduced the spacing between adjacent turns, compressed the deposited turns against the hub, and could be quickly and easily moved into and out of normal operating position without interrupting the winding operation. As compared with the standard clamping assemblies, significantly fewer adjustments were required and winding time was decreased.

FIG. 2 illustrates an alternative form of the invention, in which the train of balls 45 (FIG. 1) is replaced by a generally conventional roller chain 49 including rollers 51 and side plates 53 and 55. The shaft 27 applies thrust to the lug 41 via the chain. A generally H-shaped channel 57 serves the purposes of the above-mentioned passages and groove. As shown, the channel consists of a central passage for the bearing surfaces of the rollers and side passages for the side plates. The lug 41 (FIG. 1) is contoured to slide in the channel. The term "train of rollable articles" is used herein to include loose or caged balls or rollers, and equivalents thereof.

The foregoing description of a preferred embodiment of the invention has been presented for purposes of illustration and description. It is not intended to be exhaustive or to limit the invention to the precise form disclosed, and obviously many modifications and variations are possible in light of the above teaching. For instance, the above-described T-shaped member may be of any configuration consistent with achieving the objectives of the invention. Also, it will be apparent to those versed in the art that the clamping apparatus is applicable to coils of various configurations and formed of elongated articles of various types. Although the apparatus has been illustrated as oriented for use with vertically extending coils, the apparatus may be used in various other orientations. Any suitable means may be used to apply force to the train of rollable articles; as one example, the means may be a fluid-actuated cylinder bearing directly on an end of the train. The coil may be wound on any suitable support. The support may be rotatable, as in the case of the hub 11, or it may be stationary, as in applications where the coil is formed by revolution of the conductor or other elongated article about the support.

It is intended that the scope of the invention be defined by the claims appended hereto.

What is claimed is:

1. Apparatus for applying force to turns of a helical coil wound about a rotatable support, comprising:

a rigid member having an axis, said member being mounted to rotate with said support and being arcuately movable about an axis parallel with the axis of said member, said member having a face confronting said turns for compressing said turns against said support, said face being formed with a groove extending transversely of said turns, a longitudinally extending passage in said member connected to said groove to form therewith a continuous guideway for rollable articles, a rigid lug mounted in said groove for longitudinal movement therein and having a projection which extends laterally from said groove, said projection having an end face confronting said hub and having a lateral face confronting a face of the last-formed turn of said coil, a train of rollable articles in said guideway inwardly of said lug for movement therein, and means for applying force to the end of said train relatively remote from said lug to urge said lateral face thereof against said face of the last-formed turn of said coil to displace said turn along the face of said support; the force so applied to said lug being translated, up cessation of the displacement of said turn, to a force which urges said face of said member against said turns to compress them against said support.

2. In combination with coil-forming apparatus including a vertically disposed coil-support:

a horizontally movable rigid member mounted adjacent to said support, said member comprising a horizontally extending first arm affixed to the central section of a vertically extending second arm, the second arm having a face which confronts said support and has a vertical groove therein, a rigid lug slidably mounted in said groove, said lug having a projection extending out of said groove and toward said support, a longitudinally extending passage in the first arm, said passage being connected to said groove by a generally S-shaped passageway; said passage, groove, and passageway forming a continuous guideway, a movable train of rigid articles disposed in said guideway for transmitting force to said lug; and means for applying force to said train to effect movement of said lug in said groove; said force translating, upon cessation of movement of said lug, to a force urging said member toward said support.

3. The apparatus of claim 2 wherein said articles are balls.

4. The apparatus of claim 2 wherein said articles are rollers.

5. The apparatus of claim 4 wherein said rollers are incorporated in a roller chain.

6. Force-applying apparatus comprising:

a horizontally extending rigid member having an axis and having a vertically extending end face normal to said axis, said face having a vertically extending groove formed therein, a longitudinally extending passage in said rigid member communicating with said groove via a generally S-shaped passageway; said passage, groove, and passageway forming a continuous guideway for rollable articles, a rigid lug mounted in said groove for longitudinal movement therein, said lug having a projection extending laterally out of said groove, a train of rollable, rigid articles disposed in said guideway inwardly of said lug, for movement therein; and means for applying force to the end of said train relatively remote from said lug to exert force on said lug to urge the same longitudinally in said groove.

7. The apparatus of claim 1 wherein said articles are balls.

8. The apparatus of claim 1 wherein said articles are rollers.

9. The apparatus of claim 1 wherein said member is mounted for arcuate movement about an axis parallel to said axis.

10. A clamping device, comprising:

a base, a horizontally movable rigid member mounted thereon, said member having a forward end terminating in a face having a vertically extending groove therein, a rigid lug mounted in said groove for movement therein and formed with a lateral projection extending out of said groove, a longitudinally extending passage in said member and communicating with said groove via a generally S-shaped passageway; said passage, groove, and passageway forming a continuous guideway, a train of rigid articles disposed in said guideway for transmitting force to said lug; and means for applying force to said train to urge said lug to move in said groove, said force translating, upon cessation of movement of said lug in said groove, to force urging said member to move in the forward direction.

* * * * *